US008931289B2

(12) United States Patent
Cameron et al.

(10) Patent No.: US 8,931,289 B2
(45) Date of Patent: Jan. 13, 2015

(54) REFRIGERANT RECYCLING SYSTEM

(75) Inventors: Edward R. Cameron, Edina, MN (US); Richard Gordan Christensen, Osceola, WI (US); Magalage Neville Perera, Eden Prairie, MN (US)

(73) Assignee: Appliance Recycling Centers of America, Inc., Minneapolis, MN (US)

( * ) Notice: Subject to any disclaimer, the term of this patent is extended or adjusted under 35 U.S.C. 154(b) by 826 days.

(21) Appl. No.: 13/085,044

(22) Filed: Apr. 12, 2011

(65) Prior Publication Data

US 2012/0265352 A1 Oct. 18, 2012

(51) Int. Cl.
*F25B 45/00* (2006.01)

(52) U.S. Cl.
CPC ..... *F25B 45/00* (2013.01); *F25B 2345/002* (2013.01); *F25B 2345/006* (2013.01); *F25B 2345/003* (2013.01)
USPC ..... 62/149; 62/192; 62/468

(58) Field of Classification Search
CPC .. F25B 45/00; F25B 31/002; F25B 2345/002; F25B 2345/003; F25B 2345/004; F25B 43/02; F25B 2700/03
USPC ..... 62/77, 84, 149, 192, 193, 292, 468
See application file for complete search history.

(56) References Cited

U.S. PATENT DOCUMENTS

| | | | | |
|---|---|---|---|---|
| 4,363,222 | A | 12/1982 | Cain | |
| 5,167,126 | A | 12/1992 | Cartwright | |
| 6,263,691 | B1 * | 7/2001 | Ueno et al. | 62/292 |
| 6,609,381 | B1 | 8/2003 | Morgan | |
| 7,086,237 | B2 | 8/2006 | Arshansky et al. | |
| 2007/0130971 | A1 * | 6/2007 | Thybo et al. | 62/180 |

FOREIGN PATENT DOCUMENTS

| | | |
|---|---|---|
| WO | 2006098848 | 9/2006 |

* cited by examiner

*Primary Examiner* — Marc Norman
(74) *Attorney, Agent, or Firm* — Vidas, Arrett & Steinkraus

(57) ABSTRACT

Systems and methods are described with respect to refrigerant recovery techniques. In one example, a system for recovering a refrigerant from an appliance includes a valve module, a separator, a degasser, and a system controller. The valve modules include a valve and a valve controller configured to control the valve and transmit data. The separator separates the refrigerant from an oil and is in fluid communication with the valve. The degasser further separates the refrigerant from the oil and is in fluid communication with the separator. The system controller is configured to receive data from the valve controller.

19 Claims, 6 Drawing Sheets

REFRIGERANT RECYCLING SYSTEM

TECHNICAL FIELD

The disclosure relates to appliance recycling and, more particularly, to refrigerant recovery systems.

BACKGROUND

A refrigerant is a substance used for its thermodynamic properties in common household appliances, such as refrigerators, freezers, and air conditioners. A refrigerant is capable of reversibly changing between a gas and a liquid and transferring heat during a heat cycle. Many refrigerants, such as R-12 and R-134a, are environmentally harmful substances. Under the Clean Air Act, it is illegal to vent refrigerants during any service, maintenance, repair or disposal of an appliance. Thus, refrigerants must be removed and captured properly during appliance disposal and/or recycling.

SUMMARY

In general, this disclosure describes systems and techniques that facilitate the recovery and recycling of refrigerant and oil from refrigerators, freezers, air conditioners and similar appliances that contain refrigerants in their sealed systems. In accordance with this disclosure, the recovery system includes automation and incorporates data logging.

In one example, this disclosure is directed to a system for recovering a refrigerant from an appliance. The system comprises a valve module comprising a valve and a valve controller, the valve controller configured to control the valve and transmit data, a separator that separates the refrigerant from an oil, the separator in fluid communication with the valve, a degasser that further separates the refrigerant from the oil, the degasser in fluid communication with the separator, and a system controller configured to receive data from the valve controller.

In another example, this disclosure is directed to a method of evacuating fluid from an appliance, the method comprising prompting a user to log in using a user identifier; in response to receiving the user identifier, enabling a start switch; upon user activation of the start switch, receiving a first pressure value for a first side of the valve and a second pressure value for a second side of the valve and determining a difference value between the first pressure value and the second pressure value; controlling the valve to open, without user intervention, to begin evacuation of the fluid in the appliance if the determined difference value is within a predetermined range of values; and controlling the valve to close, without user intervention, to complete evacuation of the fluid.

In another example, this disclosure is directed to a system for evacuating fluid from an appliance, the system comprising means for prompting a user to log in using a user identifier; in response to receiving the user identifier, means for enabling a start switch in response to the user logging in; means for receiving, upon activation of the start switch, a first pressure value for a first side of the valve and a second pressure value for a second side of the valve and determining a difference value between the first pressure value and the second pressure value; means for controlling the valve to open, without user intervention, to begin evacuation of the fluid in the appliance if the determined difference value is within a predetermined range of values and starting a timer at a start time; and means for controlling the valve to close, without user intervention, to complete evacuation of the fluid and stopping the timer at a stop time.

The details of one or more aspects of the disclosure are set forth in the accompanying drawings and the description below. Other features, objects, and advantages will be apparent from the description and drawings, and from the claims.

DETAILED DESCRIPTION

This disclosure describes systems and techniques that facilitate the recovery and recycling of refrigerant and oil from refrigerators, freezers, air conditioners, and similar appliances that contain refrigerants in their sealed systems. Using various techniques described in this disclosure, the system incorporates various levels of automation to reduce the number of human operators required during the refrigerant recovery process and to reduce the opportunities for operator error. Further, certain techniques described in this disclosure incorporate integrated data logging to enable reporting of events and data related to the refrigerant recovery process.

Generally speaking, using other systems to recover refrigerant, e.g., R-12, R-134a, and the like, from an appliance, e.g., a refrigerator, an operator connects the sealed system of the appliance that contains the refrigerant to a valve. The operator manually opens the valve, which allows a fluid containing refrigerant entrained in oil to flow to an oil separator. The separator is designed to extract the refrigerant from the oil by converting the refrigerant to a gas, while leaving the oil as a liquid. Such separators are well known to those of ordinary skill in the art and will not be described in detail. The refrigerant gas is pumped out of the separator and into a refrigerant tank.

Most separators have some inherent inefficiency and thus the oil remaining in the separator after the separation process still contains a small percentage of refrigerant. As such, some systems include a degasser to further purify the oil and reclaim the entrained refrigerant. In such a system, an operator manually activates a pump in order to pump the oil from the separator to the degasser. The operator turns on the degasser, which extracts the remaining refrigerant from the oil. The operator turns on a pump that pumps the refrigerant either to the separator or to the refrigerant tank and pumps the oil to an oil collection tank.

As described in detail below and in accordance with various techniques of this disclosure, many of the steps described above with respect to other systems are automated such that no user intervention is required to perform those steps. In addition, various techniques described in this disclosure enable data related to the refrigerant recovery process, e.g., barcodes, operator identifiers (IDs), start times and end times, and recovered refrigerant weights, to be captured, logged, and displayed to a user.

Figure 1:
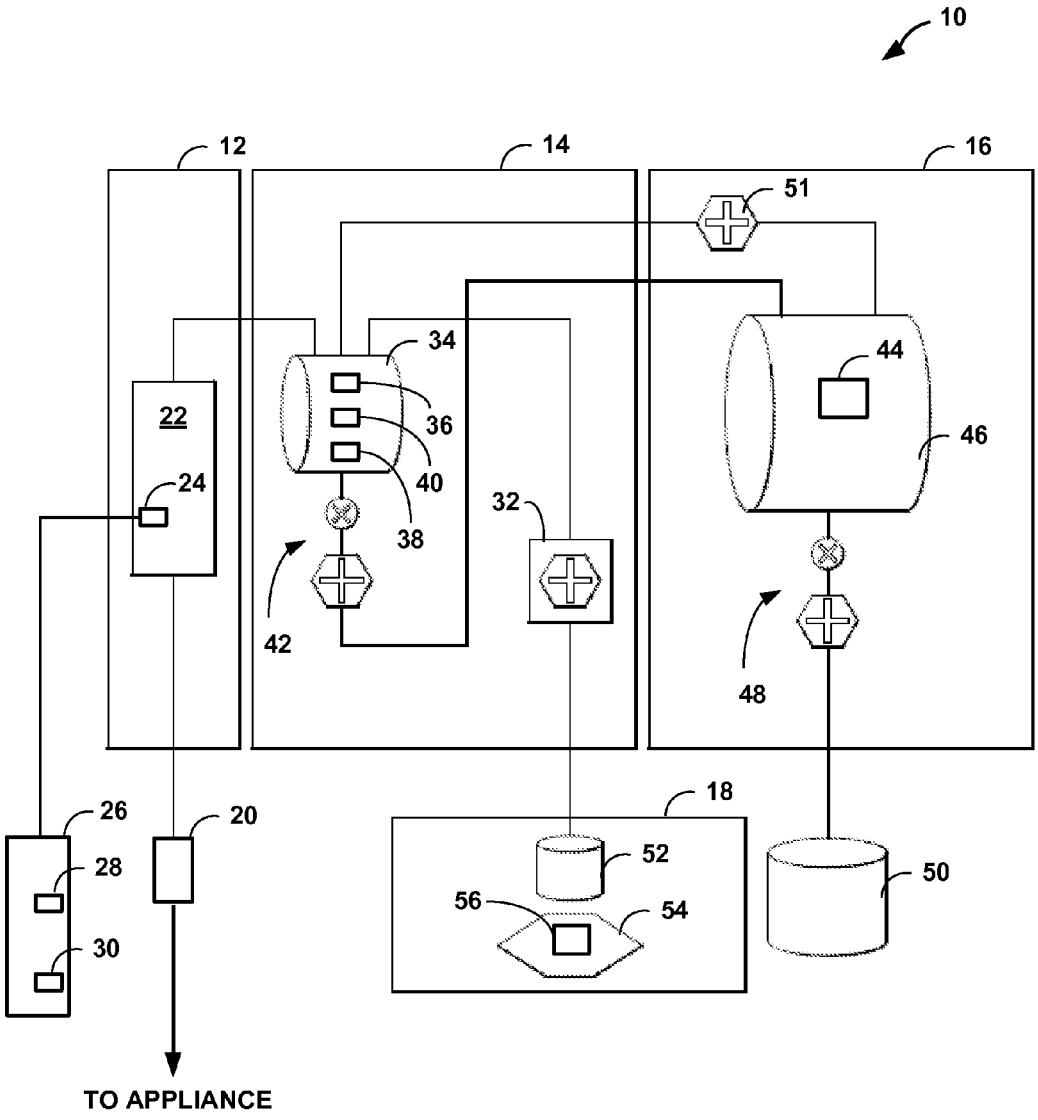
FIG. 1 is a block diagram illustrating one example refrigerant recovery system implementing various techniques of this disclosure.

FIG. 1 is a block diagram illustrating one example refrigerant recovery system implementing various techniques of this disclosure. In the example configuration shown in FIG. 1, the refrigerant recovery system, shown generally at 10, includes valve module 12, separator module 14, degassing module 16, and scale module 18. In some examples, each module has an associated controller, as described in more detail below. In one example configuration, the controllers communicate with one another using a controller area network ("CAN") bus messaging protocol.

As seen in FIG. 1, valve module 12 connects to pliers 20. In order to recover refrigerant, e.g., R-12, R-134a, and the like, from an appliance, e.g., a refrigerator, an operator attaches pliers 20 to a sealed system of the appliance that contains the refrigerant. For example, the operator may use piercing pliers 20 to pierce tubing connected to the sealed system of the appliance. Pliers 20 are connected to tubing that connects to valve module 12, thereby creating a flow path between the appliance and system 10. System 10 may further include a hydraulically actuated lifting mechanism that positions the appliance in such a way that allows pliers 20 to attach to the sealed system of the appliance at the lowest level possible, thereby maximizing the potential for full recovery of the oil and refrigerant mixture.

In one example configuration and in accordance with this disclosure, valve module 12 includes valve 22 and valve controller 24, shown and described in more detail below with respect to FIG. 3, as well as a pressure sensor on the appliance side of valve module 12 and a pressure sensor on the system side of valve module 12. Generally speaking, valve controller 24 controls, without user intervention, the opening and closing of valve 22, tracks operator log in data, e.g., operator ID and timestamps, and communicates with other modules of system 10 including, for example, separator module 14 and a system controller (not shown in FIG. 1). Valve controller 24 can include any one or more of a controller, a microprocessor, an application specific integrated circuit (ASIC), a digital signal processor (DSP), a field-programmable gate array (FPGA), or equivalent discrete or integrated logic circuitry. The functions attributed to valve controller 24 in this disclosure may be embodied as hardware, software, firmware, as well as combinations of hardware, software, and firmware.

In one example configuration, system 10 further includes barcode reader module 26 comprising barcode reader 28 and barcode reader controller 30. Barcode reader controller 30 is configured to transmit barcode data associated with the appliance to a memory device, e.g., a computer-readable storage media, contained in, for example, valve module 12, a system controller, or both. The computer-readable storage media includes, for example, random access memory (RAM), read-only memory (ROM), non-volatile RAM (NVRAM), electrically-erasable programmable ROM (EEPROM), flash memory, or any other volatile, non-volatile, magnetic, optical, or electrical media.

Figure 4:
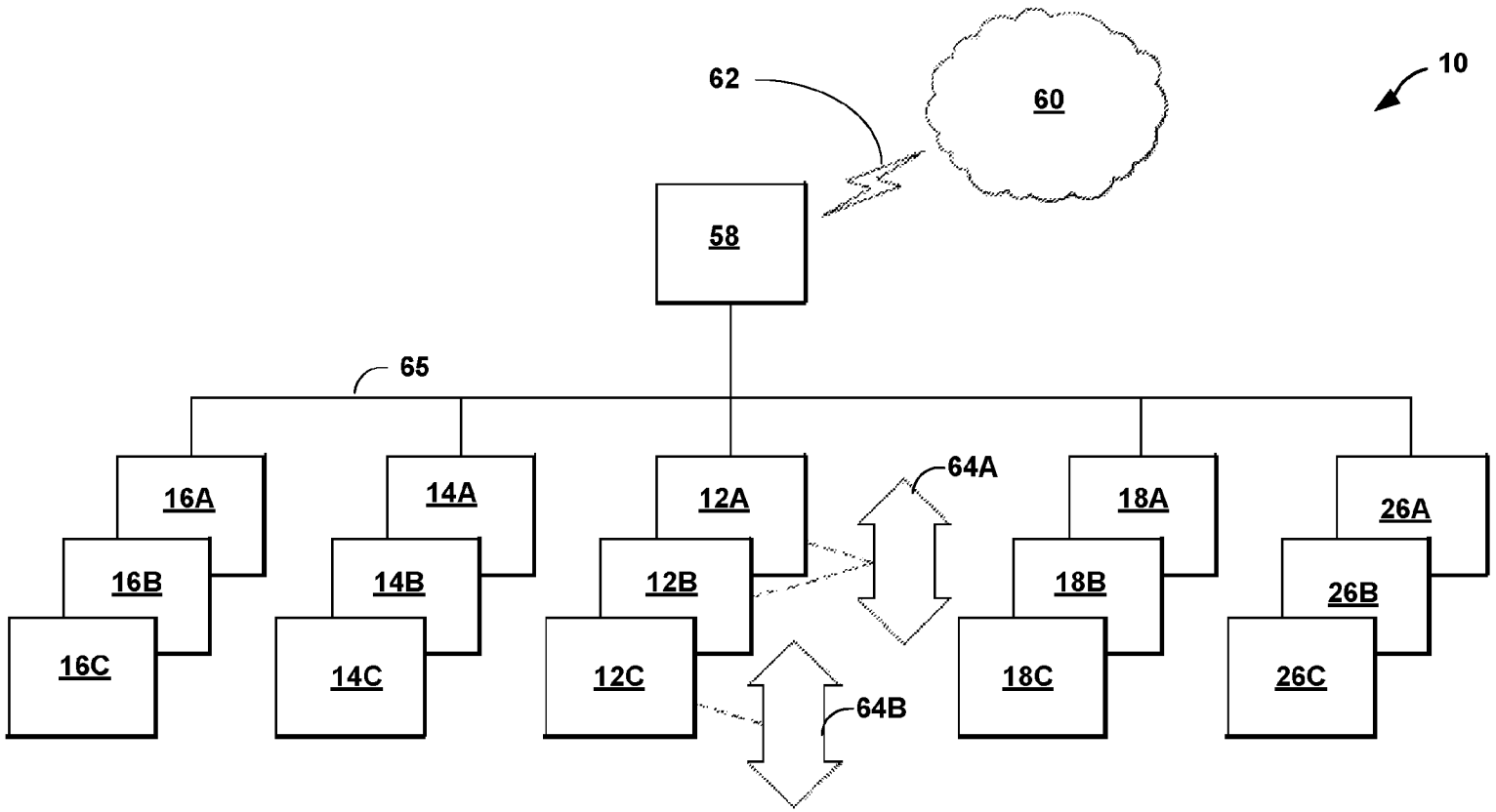
FIG. 4 is a block diagram illustrating one example configuration of a refrigerant recovery system, in accordance with various techniques of this disclosure.

By way of specific example, in order to recover refrigerant from an appliance, an operator uses a lifting mechanism, e.g., hydraulically actuated lifting mechanism 64A of FIG. 4, to position the appliance. After the operator attaches pliers 20 to the appliance and logs into system 10, valve module 12 and, in particular, valve controller 24, proceeds through the control logic described in detail below with respect to FIG. 2. Pump 32 of FIG. 1 creates the negative pressure used to control the flow of oil and refrigerant to separator tank 34 of separator module 14.

Separator module 14 also includes first fill sensor 36, second fill sensor 38, and separator controller 40. Separator controller 40 controls separator tank 34 to begin separating the oil/refrigerant mixture into liquid oil and gas refrigerant. The liquid oil remains at the bottom of separator tank 34 and the gas refrigerant rises to the top of separator tank 34 and is extracted via pump 32 to refrigerant tank 52 of scale module 18. To prevent oil from flowing into refrigerant tank 52, first fill sensor 36, e.g., an optical sensor, monitors a high fill level of separator tank 34 and sends a signal to separator controller 40 when that high fill level is reached.

Upon receiving the high fill level indication from first fill sensor 36, separator controller 40 determines whether degassing module 16 is ready to accept oil from separator tank 34 via an actuated valve and pump combination, shown generally at 42, based on a status in a message received from degassing controller 44. That is, degassing controller 44 monitors whether degassing tank 46 is in the process of degassing oil sent from separator module 14 and sends separator module controller 40 a message with an indication, e.g., a status flag, indicating whether degassing module 16 is ready to accept oil from separator module 14 or whether separator module 14 should wait to send oil. Separator module 14 stores current status messages of other modules, e.g., degassing module 16. If degassing module 16 is ready to accept oil from separator module 14, then actuated valve and pump combination 42 pumps oil to degassing module 16 for degassing. Once the oil fill level in separator tank 34 reaches second fill sensor 38, e.g., an optical sensor, separator controller 40 stops actuated valve and pump combination 42 from pumping any more oil into degassing tank 46 in order to keep some oil in separator tank 34. It should be noted that first fill sensor 36 is at a higher level than second fill sensor 38 in separator tank 34. If, for example, degassing module 16 is not ready to accept oil from separator module 14, separator controller 40 will prevent actuated valve and pump combination 42 from pumping oil to degassing module 16. Separator controller 40 can log data related to the operation of separator module 14 and/or transmit data to the other controllers of system 10, including a system controller.

In addition, if necessary, valve controller 24 may prevent valve module 12 from opening valve 22 if separator tank 34 is filled and degassing module 16 is not ready to accept oil from separator module 14. That is, separator controller 40 transmits messages to other modules, including valve module 12, indicating the status of separator module 14. Valve controller 24 determines whether separator module 14 is ready to receive oil based on the most recent status message received from separator controller 40 over the CAN-bus. If valve controller 24 determines that separator module 14 is not ready to receive oil, then valve controller 24 does not open valve 22 to start the evacuation process.

Referring again to degassing module 16, after degassing, degassed oil processed by degassing module 16 is evacuated from degassing tank 46 via an actuated valve and pump combination, shown generally at 48, and into oil collection tank 50. Any refrigerant extracted from the oil in degassing tank 46 via the degassing process is evacuated from degassing tank 46 via evacuation pump 51 and into separator tank 34, where it is eventually pumped into refrigerant tank 52 by recovery pump 32. Degassing controller 44 can log data related to the operation of degassing module 16 and/or transmit data to the other controllers of system 10, including a system controller.

Scale module 18 includes refrigerant tank 52, scale 54, and scale controller 56. Using the techniques of this disclosure, scale controller 56 controls scale 54 to take weight readings of refrigerant tank 52, e.g., after a particular number of appliances have been evacuated. These readings can be stored in scale controller 56. Scale controller 56 may then transmit the readings to system controller 58 (FIG. 4). In other words, scale controller 56 can log data related to the operation of scale module 18 and/or transmit data to the other controllers of system 10, including a system controller.

In other examples, after an operator logs in, valve controller 24 may transmit a message to scale controller 56 to take a first reading of the weight of refrigerant tank 52. When the operator logs out, valve controller 24 may transmit a message to scale controller 56 to take a second reading of the weight of refrigerant tank 52 and compute a difference between the first and second readings.

In other examples, at a first time, valve controller 24 may transmit a message to scale controller 56 to take a first reading of the weight of refrigerant tank 52. At a second time, valve controller 24 may transmit a message to scale controller 56 to take a second reading of the weight of refrigerant tank 52 and compute a difference between the first and second readings.

In one example, a user may want to know the weight of refrigerant tank 52. As such, a user may use a user device, e.g., user device 70 of FIG. 5, to query scale controller 56 directly to take a reading of tank 52. Or, in another example, a user may use a user device, e.g., user device 70 of FIG. 5, to query scale controller 56 directly to take a reading of tank 52

Like valve controller 24, the other controllers of system 10, including separator controller 40, degassing controller 44, scale controller 56, barcode reader controller 30, and system controller 58 can include any one or more of a controller, a microprocessor, an application specific integrated circuit (ASIC), a digital signal processor (DSP), a field-programmable gate array (FPGA), or equivalent discrete or integrated logic circuitry. The functions attributed to valve controller 24 in this disclosure may be embodied as hardware, software, firmware, as well as combinations of hardware, software, and firmware. In at least one example configuration, each of the controllers described within this disclosure includes, or is in communication with, a computer-readable storage media that is configured to store computer-readable instructions, received data, and the like.

As described above, in some example configurations, the various controllers independently control operation of their respective modules, although sometimes the control is based on a status of another module. In other words, in some example configurations, system 10 utilizes a distributed intelligence model. For example, valve controller 24 controls operation of valve module 12, separator controller 40 controls operation of separator module 14, degassing controller 44 controls operation of degassing module 16, and so forth.

In other example configurations, system controller 58 controls operation of the various modules via a module's respective controller. In other words, in some example configurations, system 10 utilizes a centralized intelligence model. For example, status messages are transmitted to system controller 58, which then transmits control messages over CAN bus 65 using a protocol such as CAN 2.0 B to the various module controllers to control their operation. Whether or not system controller 58 is used to control the various modules of system 10 during normal operation, in some examples, system controller 58 can be used to run system diagnostics on particular modules of system 10.

In some examples, one or more of the modules of system 10 transmit data messages to system controller 58 for storage, formatting, and the like. For example, separator module 14 and, in particular, separator controller 40 may transmit a message to system controller 58 that indicates the fill level of separator tank 34. As another example, scale module 18 and, in particular, scale controller 56 may transmit a message to system controller 58 that indicates the weight of refrigerant tank 52. System controller 58 stores this data and either automatically or upon request from a user, periodically transmits the data or reformatted version thereof via the Internet or an intranet, upon request thereby allowing one or more users to access the data.

Figure 2:
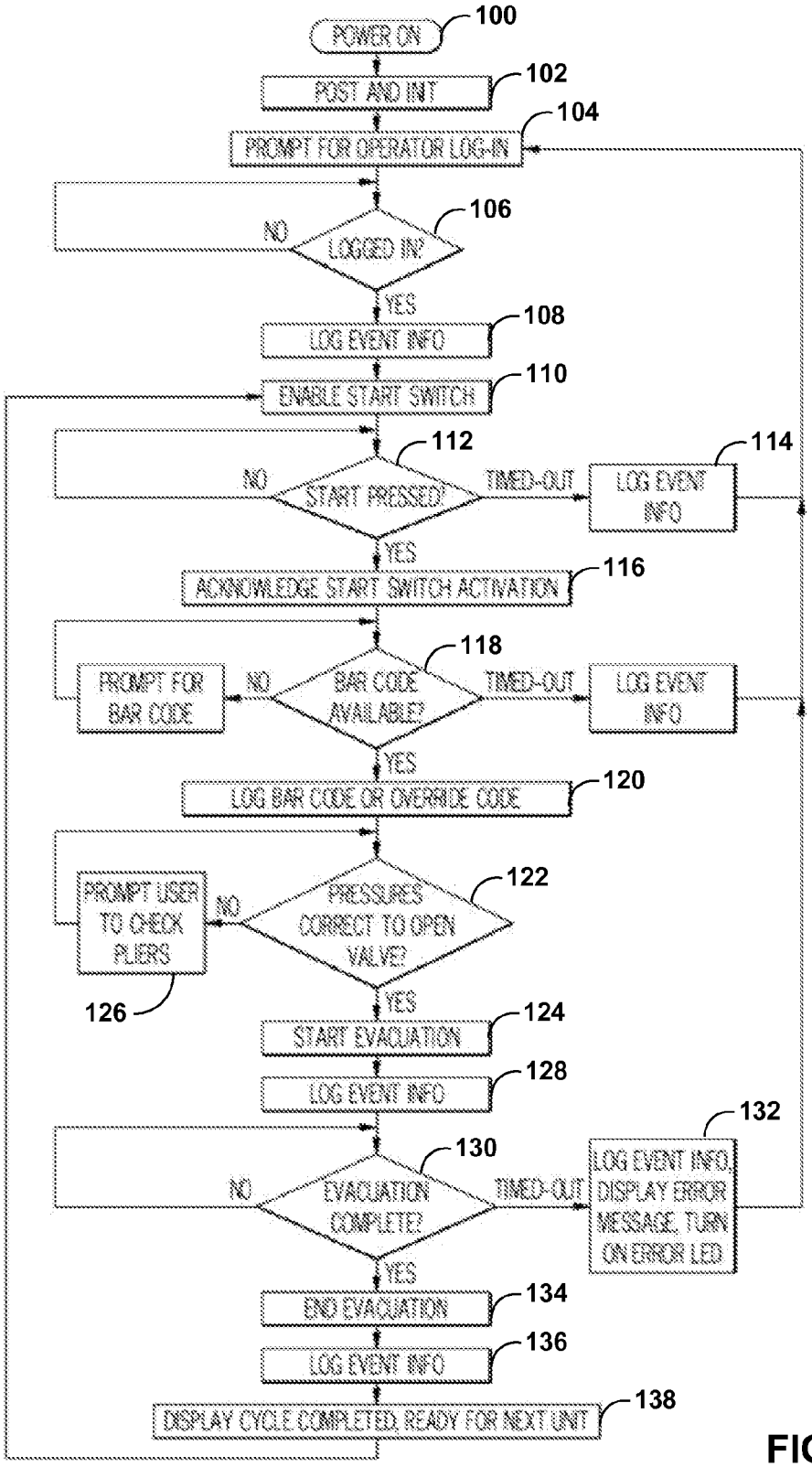
FIG. 2 is a flow diagram illustrating one example of control logic implemented by a valve module, in accordance with certain techniques of this disclosure.

FIG. 2 is a flow diagram illustrating one example of control logic implemented by valve module 12, in accordance with certain techniques of this disclosure. As seen in FIG. 2, valve module 12 is powered on (100), after which valve module 12 performs a power on self-test ("POST") that runs a diagnostics test, and performs an initialization ("INT") that initializes ports and a display associated with valve module 12 (102). Valve controller 24 controls the display to display any errors. In some examples, if there are no errors or failures found in its sub-systems, valve controller 24 controls the display to display a splash screen. In one example, an elapsed-time light-emitting diode ("LED") display illuminates and then clears all its segments during the POST and INT test.

In addition, in one example implementation of POST and INT, valve controller 24 controls valve 22, e.g., an actuated ball-valve, to close if valve controller 24 determines that valve 22 is in an open position during the POST and INT. Further, valve controller 24 may test the pressure sensors of valve module 12 for expected functionality. Valve controller 24 determines the status of valve 22, i.e., open or closed status, and verifies that valve 22 reaches the specified status after each command to the valve.

Following successful POST and INT, valve module 12 prompts the operator to log in to system 10 and, in particular, valve module 12 (104). Valve controller 24 controls an operator ID reader, e.g., reader 206 of FIG. 3, to prompt the operator to log in. In one example, valve controller 24 controls LEDs on a display in communication with the reader, e.g. display 214 of FIG. 3, to flash. Additionally or alternatively, in another example, valve controller 24 controls a display, e.g., display 216 of FIG. 3, to display a message notifying the operator that a log-in is required to begin the appliance evacuation process.

When the operator logs in, e.g., places a device such as an iButton (available from Maxim and described at www.maxim-ic.com/products/ibutton/ibuttons), radio frequency identification (RFID) tag, or other electronic key near the ID reader, the unique ID of the iButton, RFID tag, or electronic key, e.g., a 48-bit ID, is read and compared against a stored set of authorized IDs for authentication. In one example, valve controller 24 transmits the ID to a system controller, e.g., system controller 58 of FIG. 4, for validation and operator look-up. In another example, the stored set of authorized IDs for authentication may reside in memory associated with valve module 12.

Based on the comparison against the stored set of authorized IDs, which returns a status such as valid ID, invalid ID, unrecognized ID, or deleted ID, valve module 12 either proceeds to log the operator in ("YES" branch of block 106) and displays a message such as "Hello 'operator-name,'" or loops back and prompts the operator to log in ("NO" branch of block 106) after displaying a message such as "Invalid key, please try again" or "Cancelled key, please use a valid key." This ensures that an operator logs in to the system before the system can be used, thereby enabling all data collected to be correlated to individual operators, and enabling accurate reporting of operator performance and work-load. In one example, valve module 12 indicates successful operator log-in via a confirmation beep and by switching off the flashing ID reader LED and clearing the log-in message on its display. As seen at 108, event information such as operator ID and the date and time (timestamp information) that the operator logged in are logged. In some examples, the event information is transmitted to the system controller. In other examples, the event information may be stored locally at the valve module 12.

Following operator log-in and event logging, valve module 12 enables the start switch and waits for the operator to press a start button (110). Pressing the start button ("YES" branch of 112) initiates the evacuation cycle. Generally speaking, the operator has positioned the appliance using the hydraulically actuated lifting mechanism that positions the appliance and attached the pliers 20 to the appliance's sealed system before pressing the start button. If the operator delays pressing the start button beyond a predetermined period of time, the operation times out ("TIMED-OUT" branch of block 112) and data including the operator ID and the timestamp are logged (114).

Upon detecting that the start button was pressed ("YES" branch of block 112), valve module 12 and, in particular, valve controller 24, acknowledges start switch activation (116) by, for example, displaying a message on the display. Next, valve module 12 prompts the operator to scan the barcode associated with the appliance (118) using barcode reader 28 of barcode reader module 26. If the appliance has a barcode ("YES" branch of 118), barcode reader controller 30 transmits the scanned barcode data to a memory device of, for example, valve controller 24, the system controller, or both for logging purposes (120). In one example, valve controller 24 transmits the scanned barcode data to the system controller in a message over the CAN-bus. The system controller determines if there is a barcode that identifies that particular appliance, e.g., using an appliance turn-in order ("ATO") number.

If the appliance does not have a barcode, an override barcode may be used for scanning (120), thereby allowing consistency in the operator's procedures (e.g., always read a barcode for each unit recycled). Barcode and timestamp information is used, e.g., by a system controller, to enable unit count logging, the U.S. Environmental Protection Agency's Responsible Appliance Disposal program ("U.S. EPA RAD") data collection, as well as verification to ATO customers that the unit was physically processed, along with other data collected during that particular unit's evacuation.

After the barcode is read by barcode reader 28, valve controller 24 verifies the pressures on both the appliance side and the separator side of valve 22 using pressure sensors associated with the respective sides (122). The following are the possible states that the sensors could be reporting and their associated conditions:

| Appliance-side pressure sensor | Separator-side pressure sensor | Condition |
|---|---|---|
| Atmospheric pressure | Don't care | Pliers not attached or not correctly attached. Appliance has a leak in sealed system. Appliance has already been evacuated. |
| Don't care | Above about 20 inches of mercury (inHg) vacuum | Separator not ready for evacuation. |
| Above atmospheric pressure (by | At or below about 20 inHg vacuum | Conditions right for evacuation. |

-continued

| Appliance-side pressure sensor | Separator-side pressure sensor | Condition |
|---|---|---|
| at least 3 pounds per square inch (psi)) | | |

If valve controller 24 determines that the pressures are correct ("YES" branch of block 122), then valve controller 24 controls, without user intervention, valve 22 to open, controls emission of a confirmation beep and lights up the BUSY LED, thereby initiating evacuation of the appliance (124). If valve controller 24 determines that the pressures are not correct ("NO" branch of block 122), then valve module 12, for example, displays an error message, lights up an ERROR LED, and emits an error beep sequence. In addition, valve controller 24 may prompt the user to check the connection of the pliers to the appliance (126).

Upon initiating evacuation, valve module 12 continues data collection (128). It should be noted that the appliance data collection can be configured to be either enabled or disabled at set-up time. If enabled, valve controller 24 controls pressure conditions to be logged, along with timestamp information. In some examples, valve controller 24 transmits the logged data to the system controller.

Valve controller 24 controls valve 22, e.g., an actuated ball valve, to open without user intervention. For example, valve controller 24 energizes a relay, e.g., a solid-state relay, which opens valve 22. Valve controller 24 verifies that valve 22 opened. For example, valve controller 24 may wait a valve activation time and then read the valve status switches. If valve 22 did not open as commanded, valve controller 24 displays an error message indicating a failed valve operation.

Upon successful opening of valve 22, valve controller 24 starts an elapsed time counter, begins flashing a BUSY LED, waits a predetermined period of time, e.g., two minutes, and then closes valve 22, without user intervention, by de-energizing the open relay and energizing the close relay. It should be noted that this time variable is one of several user changeable parameters, which may be defined globally at system set-up time or via a diagnostics/set-up functionality associated with valve module 12 or the system controller.

After initiating a "close valve" command, valve controller 24 verifies the valve status. After valve controller 24 determines that valve 22 is closed, valve controller 24 waits a predetermined period of time, e.g., two seconds for pressure stabilization, and then reads the two pressure sensors on either side of closed valve 22 to determine if evacuation is complete (130). If the appliance side of valve 22 has not reached 10 inHg ("NO" branch of block 130), valve controller 24 will re-open valve 22, thereby allowing evacuation of the appliance to continue until this condition is met or a predefined cycle count has been exceeded.

If the pre-defined cycle count is exceeded ("TIMED-OUT" branch of block 130), valve controller 24 displays an error message and logs the event (132). In some examples, valve controller 24 transmits the logged data to the system controller. If the evacuation was successful ("YES" branch of block 130), valve controller 24 ends evacuation (134), stops the elapsed timer, turns off the BUSY LED, turns on a READY LED, and logs the successful evacuation status (136). In one example, valve controller 24 transmits the log information to the system controller. In addition, valve module 12 displays a "cycle completed" message on the display (138) and is ready for the operator to connect another appliance to be evacuated.

In one example implementation, if valve module 12 does not receive any inputs from the operator, e.g., no evacuation requests, after either a successful log-in or an evacuation completion, for a pre-determined time, e.g., 15 minutes, valve module 12 may log the operator out and log this event. In one example, the logged event is transmitted to the system controller. The valve module 12 then continues to prompt for operator log-in, as previously described.

Figure 3:
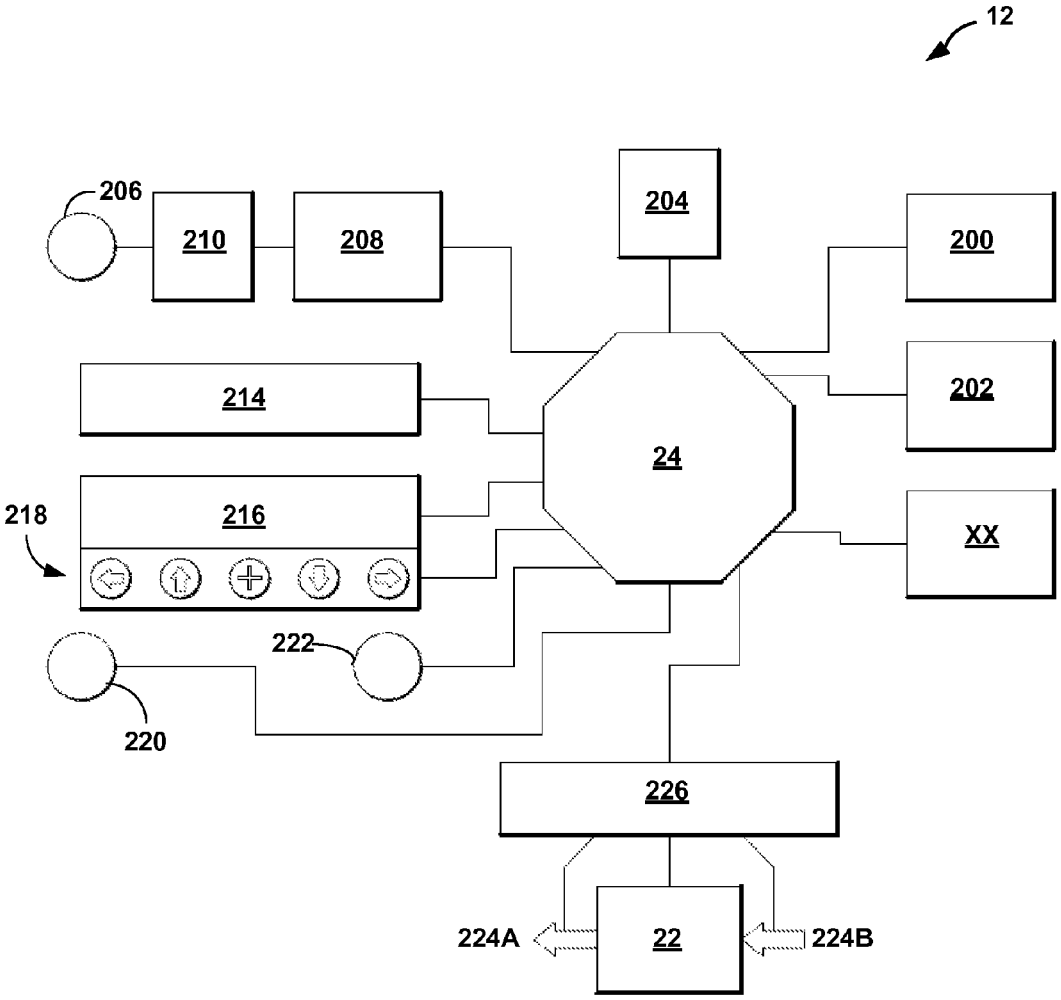
FIG. 3 is a block diagram illustrating one example configuration of a valve module, in accordance with various techniques of this disclosure.

FIG. 3 is a block diagram illustrating one example configuration of valve module 12, in accordance with various techniques of this disclosure. As mentioned above, the valve module, shown generally at 12, includes valve controller 24 and valve 22. In addition, valve module 12 includes memory 200, e.g., non-volatile memory such as FLASH memory, for storing, for example, operating parameters, data from log events, and boot code. Valve module 12 includes a communication bus interface, e.g., CAN-bus interface 202, for interfacing with a communications bus between various modules of system 10 and, in some examples, a system controller. Valve module 12 further includes clock 204, e.g., a real-time clock, reader 206, e.g., an iButton reader, that reads an operator ID at log in, and reader interface 208 for interfacing with reader 206. In some examples, electrostatic discharge ("ESD") protection 210 is included between reader 206 and reader interface 208 to prevent any damage to module 12 and, in particular, controller 24, from built up charges.

As mentioned above, valve module 12 also includes one or more displays. In the example shown in FIG. 3, valve module 12 includes display 214. Display 214 may be an LED display for displaying an elapsed time, e.g., of an evacuation cycle. Valve module 12 may further include display 216, e.g., a liquid crystal display ("LCD"), for displaying messages, splash screens, and the like. It should be noted that, in some examples, display 214 and display 216 are combined into a single display. Display 216 may further include user inputs, shown generally at 218, such as navigation buttons to allow an operator or other user to navigate menus displayed on display 216 during operation, set-up, or maintenance.

Valve module 12 further includes start switch 220. Start switch 220 may include an LED to indicate a status such as ready/busy/error. In addition, valve module 12 may include speaker 222 for providing notifications, e.g., beeps, to the operator or user that indicate errors, confirm inputs, etc.

Finally, valve module 12 includes valve 22, e.g., an actuated ball valve, pressure sensors 224A and 224B (collectively referred to as pressure sensors 224), and valve interface 226. In one example implementation, valve interface 226 can be a pair of solid state relays (SSRs) that energizes the valve motor and optically isolated sensors to read the valve open/close status outputs. Pressure sensor 224A is located on the separator side of valve 22 and pressure sensor 224B is located on the appliance side of valve 22. As described above, valve controller 24 verifies the pressures on both the appliance side and the separator side of valve 22 using pressure sensors 224 in order to determine an appliance evacuation status.

FIG. 4 is a block diagram illustrating one example configuration of a refrigerant recovery system, in accordance with various techniques of this disclosure. The example system depicted in FIG. 4, shown generally at 10, includes multiple valve modules (valve modules 12A-12C), separator modules (separator modules 14A-14C), degassing modules (degassing modules 16A-16C), scale modules (scale modules 18A-18C), and barcode reader modules (barcode reader modules 26A-26C) in communication with a system controller (system controller 58). In the example configuration depicted in FIG. 4, system controller 58 is connected to Internet 60 via connection 62. In one example, connection 62 is an Ethernet connection. In some examples, system controller 58 is additionally or alternatively connected to a corporate intranet.

FIG. 4 further depicts two hydraulically actuated lifting mechanisms 64A and 64B that each position an appliance in such a way as to allow a pliers to attach to the sealed system of a respective appliance at the lowest level possible, thereby maximizing the potential for full recovery of the oil and refrigerant mixture. In FIG. 4, lifting mechanism 64A is connected to valve modules 12A and 12B, which allows recovery of two different types of refrigerants, e.g., R-12 and R-134a, from a single appliance. Lifting mechanism 64B is connected to valve module 12C, which allows recovery of one type of refrigerant, e.g., R-12, from a single appliance. The configuration depicted in FIG. 4 allows multiple appliances to be evacuated at any given time, thereby increasing throughput.

As mentioned above, the various modules depicted in FIG. 4 communicate with one another and, in some examples, with system controller 58. For example, the various modules depicted in FIG. 4 may communicate with one another and with system controller 58 via CAN-bus 65 (e.g., as described in International Organization for Standardization ("ISO") standard 11898-2, the entire contents of which being incorporated herein by reference). In general, CAN data messages include fields such as, but not limited to, an identifier, a payload, and a cyclic redundancy check (CRC) for transmission error detection, and end of frame.

Figure 5:
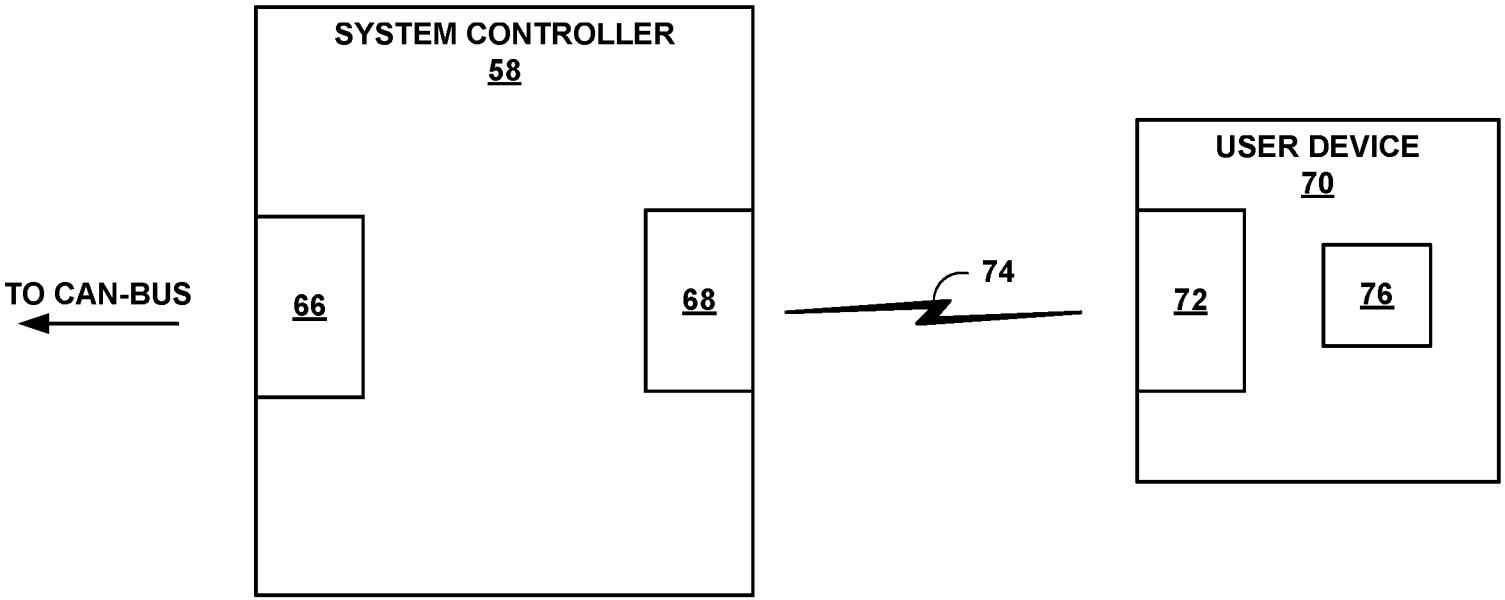
FIG. 5 is a block diagram illustrating an example system controller, in accordance with various techniques of this disclosure.

FIG. 5 is a block diagram illustrating an example system controller, in accordance with various techniques of this disclosure. System controller 58 includes CAN-bus interface 66 for communicating with the other modules of system 10 over CAN-bus 65 (FIG. 4). In addition, system controller 58 includes Ethernet interface 68 for communicating with a user device, e.g., user device 70. User device 70 also includes Ethernet interface 72. User device 70 may be, for example, a tablet computer, laptop computer, desktop computer, touch-screen display, or other computing device capable of receiving and displaying data from system controller 58. User device 70 may be connected to system controller by wireless connection 74 using wireless networking techniques, such as wireless local area network communications, e.g., IEEE standard 802.11. User device 70 further includes a user interface, including, for example, display 76 configured to display a representation of data received by system controller 58.

Figure 6:
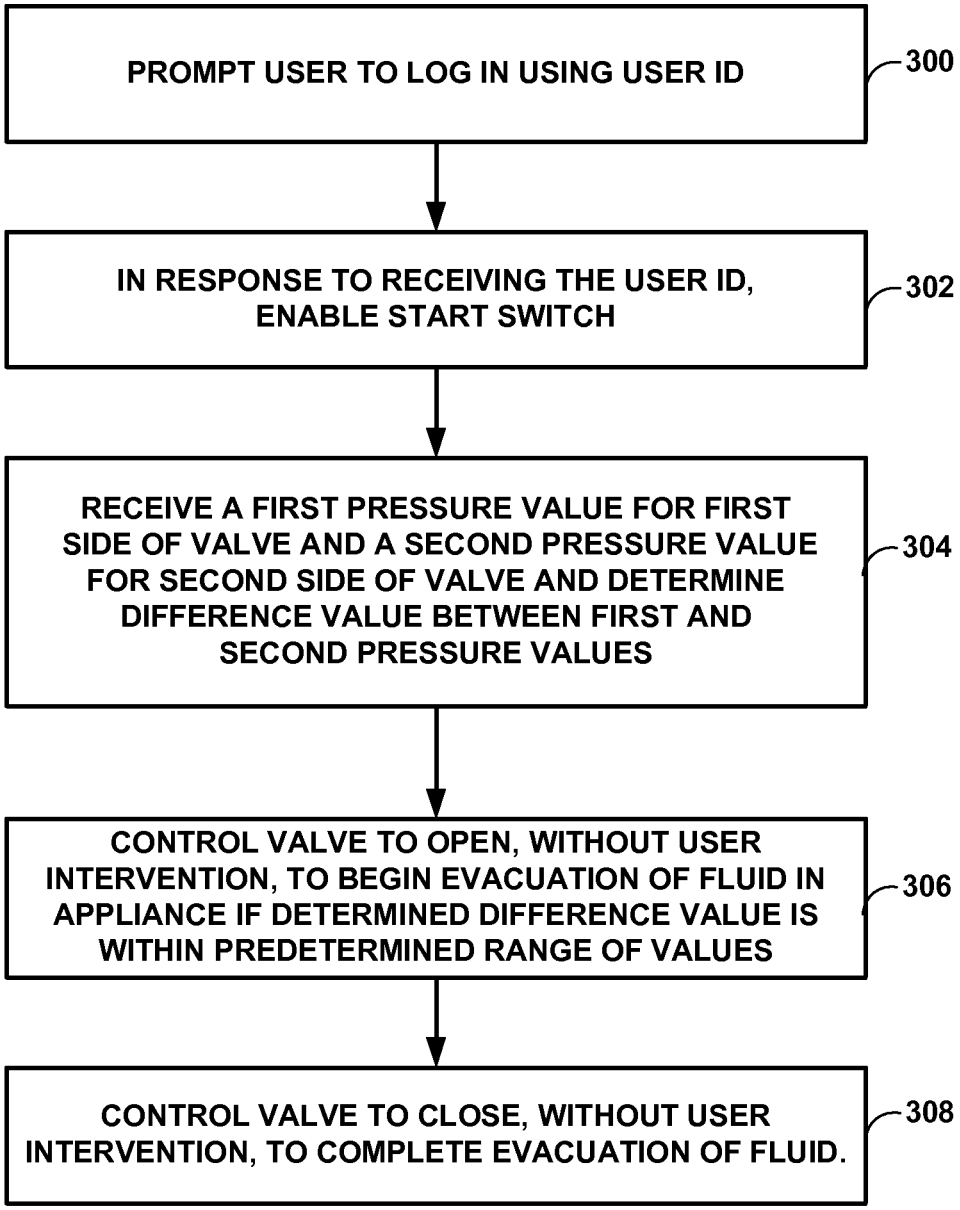
FIG. 6 is a flow diagram illustrating one example method of recovering refrigerant from an appliance, in accordance with various techniques of this disclosure.

FIG. 6 is a flow diagram illustrating one example method of recovering refrigerant from an appliance, in accordance with various techniques of this disclosure. In FIG. 6, valve module 12 and, in particular, valve controller 24 prompts a user to log in using a user ID (300). For example, valve controller 24 may control display 214 to flash LEDs. In response to receiving a valid user identifier, valve controller 24 enables a start switch, e.g., start switch 220 of FIG. 3 (302). Upon user activation of the start switch, valve controller 24 receives a first pressure value, e.g., from pressure sensor 224A, for a first side of valve 22 and a second pressure value, e.g., from pressure sensor 224B, for a second side of valve 22, and determines a difference value between the first pressure value and the second pressure value (304). In some example implementations, valve controller 24 determines whether the absolute pressures of the first pressure value and the second pressure value are within predetermined valid ranges of pressures in order to start an evacuation cycle.

If the determined difference value is within a predetermined range of values controlling the valve to open, then the separator is ready for evacuation and valve controller 24, without user intervention, begins evacuation of the fluid in the appliance (306). Valve controller 24 then controls the valve to close, without user intervention, to complete evacuation of the fluid.

In some examples, the example method shown in FIG. 6 includes additional acts, some of which are described below. For example, valve controller 24 transmits the user identifier, the start time, and the stop time to a system controller. As another example, additional acts include detecting a fill level in a separator, e.g., via first and second fill level sensors 36, 38, controlling, without user intervention, the separator, e.g., via separator controller 40, to separate the fluid into a refrigerant and oil upon detecting the fill level, receiving an indication that a degasser is ready to accept the oil from the separator, transferring the oil from the separator to the degasser, and controlling, without user intervention, the degasser, e.g., via degassing controller 44, to further separate the oil received from the separator into the refrigerant and the oil.

In another example, the method shown in FIG. 6 may also include detecting a second fill level and preventing, without user intervention, the separator, e.g., via separator controller 40, from transferring the oil to the degasser upon detecting the second fill level.

In another example, the method shown in FIG. 6 may also include detecting a fill level in a separator, e.g., via first fill sensor 36, controlling, without user intervention, the separator, e.g., via separator controller 40, to separate the fluid into a refrigerant and oil upon detecting the fill level, receiving an indication, e.g., via separator controller 40, that a degasser is not ready to accept the oil from the separator, and preventing, without user intervention, the separator, e.g., via separator controller 40, from transferring the oil to the degasser.

Many functions described above with respect to FIG. 6 were ascribed to individual controllers, e.g., valve controller 12, separator controller 40, degassing controller 44, thereby implementing a distributed intelligence methodology. However, as mentioned above, rather than using a distributed intelligence methodology, at least some of these functions may be ascribed to system controller 58, thereby implementing a centralized intelligence methodology.

Various aspects of the disclosure have been described. These and other aspects are within the scope of the following claims.

The invention claimed is:

1. A system for recovering a refrigerant from an appliance, the system comprising:

a valve module comprising a valve and a valve controller, the valve controller configured to control the valve and transmit data;

a separator that separates the refrigerant from an oil, the separator in fluid communication with the valve;

a degasser that further separates the refrigerant from the oil, the degasser in fluid communication with the separator; and a system controller configured to receive data from the valve controller.

2. The system of claim 1, wherein the valve controller is configured to:

prompt a user to log in using a user identifier;

enable a start switch in response to the user logging in;

receive, upon activation of the start switch, a first pressure value for a first side of the valve and a second pressure value for a second side of the valve;

determine a difference value between the first pressure value and the second pressure value;

open the valve to begin evacuation of the appliance if the determined difference value is within a predetermined range of values;

start a timer at a start time;

close the valve to complete evacuation of the appliance; and stop the timer at a stop time, wherein the system controller configured to receive data from the valve controller is configured to receive the user identifier, the start time, and the stop time from the valve controller.

3. The system of claim 1, further comprising:

a separator controller that controls the separator, the separator controller being in electrical communication with the valve controller; and a degasser controller that controls the degasser, the degasser controller being in electrical communication with the separator controller, wherein the separator controller and the degasser controller are in electrical communication with the system controller, and wherein the system controller is further configured to receive data from the separator controller and the degasser controller.

4. The system of claim 3, wherein the system controller is further configured to:

control operation of the valve module, the separator, and the degasser; and execute a diagnostics routine on at least one of the valve module, the separator, and the degasser.

5. The system of claim 3, further comprising:

a scale module comprising:

a refrigerant tank that stores refrigerant;

a scale that weighs the tank; and a scale controller configured to receive data from the scale and transmit the data from the scale to the system controller.

6. The system of claim 5, further comprising:

a barcode reader module comprising a barcode reader and a barcode reader controller, wherein the barcode reader controller is configured to transmit barcode data associated with the appliance to the system controller.

7. The system of claim 1, further comprising:

a user interface that displays a representation of the data received by the system controller.

8. The system of claim 7, wherein the user interface is a tablet personal computer.

9. The system of claim 7, wherein the system controller is in communication with the user interface via an intranet.

10. A method of evacuating fluid from an appliance, the method comprising:

providing the system of claim 1;

prompting a user to log in to the system using a user identifier;

in response to receiving the user identifier, enabling a start switch of the system;

upon user activation of the start switch, receiving a first pressure value for a first side of the valve and a second pressure value for a second side of the valve and determining a difference value between the first pressure value and the second pressure value;

controlling the valve to open, without user intervention, to begin evacuation of the fluid in the appliance if the determined difference value is within a predetermined range of values; and controlling the valve to close, without user intervention, to complete evacuation of the fluid.

11. The method of claim 10, further comprising:

transmitting the user identifier, astart time, and astop time to a system controller.

12. The method of claim 10, further comprising:

detecting a fill level in a separator;

controlling, without user intervention, the separator to separate the fluid into a refrigerant and oil upon detecting the fill level;

receiving an indication that a degasser is ready to accept the oil from the separator;

transferring the oil from the separator to the degasser; and controlling, without user intervention, the degasser to further separate the oil received from the separator into the refrigerant and the oil.

13. The method of claim 10, wherein the fill level is a first fill level, the method further comprising:

detecting a second fill level;

preventing, without user intervention, the separator from transferring the oil to the degasser upon detecting the second fill level.

14. The method of claim 10, further comprising:

detecting a fill level in a separator;

controlling, without user intervention, the separator to separate the fluid into a refrigerant and oil upon detecting the fill level;

receiving an indication that a degasser is not ready to accept the oil from the separator; and preventing, without user intervention, the separator from transferring the oil to the degasser.

15. A system for evacuating fluid from an appliance, the system comprising:

means for prompting a user to log in using a user identifier;

in response to receiving the user identifier, means for enabling a start switch in response to the user logging in;

means for receiving, upon activation of the start switch, a first pressure value for a first side of the valve and a second pressure value for a second side of the valve and determining a difference value between the first pressure value and the second pressure value;

means for controlling the valve to open, without user intervention, to begin evacuation of the fluid in the appliance if the determined difference value is within a predetermined range of values and starting a timer at a start time;

means for controlling the valve to close, without user intervention, to complete evacuation of the fluid and stopping the timer at a stop time;

means for detecting a fill level in a separator;

means for controlling, without user intervention, the separator to separate the fluid into a refrigerant and oil upon detecting the fill level;

means for receiving an indication that a degasser is ready to accept the oil from the separator;

means for transferring the oil from the separator to the degasser; and means for controlling, without user intervention, the degasser to further separate the oil received from the separator into the refrigerant and the oil.

16. The system of claim 15, further comprising:

means for transmitting the user identifier, the start time, and the stop time to a system controller.

17. The system of claim 15, wherein the fill level is a first fill level, the method further comprising:

means for detecting a second fill level;

means for preventing, without user intervention, the separator from transferring the oil to the degasser upon detecting the second fill level.

18. The system of claim 15, further comprising:

means for detecting a fill level in a separator;

means for controlling, without user intervention, the separator to separate the fluid into a refrigerant and oil upon detecting the fill level;

means for receiving an indication that a degasser is not ready to accept the oil from the separator; and means for preventing, without user intervention, the separator from transferring the oil to the degasser.

19. A system for recovering a refrigerant from an appliance, the system comprising:

a valve module comprising a valve and a valve controller, the valve controller configured to control the valve and transmit data;

a separator that separates the refrigerant from an oil, the separator in fluid communication with the valve;

an oil degasser that further separates the refrigerant from the oil, the degasser in fluid communication with the separator; and a system controller configured to receive data from the valve controller.

* * * * *